United States Patent [19]

Guay

[11] Patent Number: 4,649,824

[45] Date of Patent: Mar. 17, 1987

[54] APPARATUS FOR AEROSPACE VEHICLE SEPARATION EVENTS USING A LINEAR SHAPED CHARGE

[75] Inventor: Roland H. Guay, Cupertino, Calif.

[73] Assignee: The United States of America as represented by the Secretary of the Navy, Washington, D.C.

[21] Appl. No.: 749,328

[22] Filed: Jun. 27, 1985

[51] Int. Cl.[4] ..... F42B 1/02; F42B 15/10

[52] U.S. Cl. ..... 102/307; 102/378; 89/1.14

[58] Field of Search ..... 89/1.14; 102/306, 307, 102/378

[56] References Cited

U.S. PATENT DOCUMENTS

| | | | |
|---|---|---|---|
| 3,165,057 | 1/1965 | Armstrong | 102/307 |
| 3,244,104 | 4/1966 | Mills et al. | 102/378 |
| 3,336,868 | 8/1967 | Rush et al. | 102/307 |
| 3,486,410 | 12/1969 | Drexelius et al. | 89/1.14 |
| 3,919,939 | 11/1975 | Murray et al. | 102/307 |
| 3,971,290 | 7/1976 | Blain | 102/378 |
| 4,348,957 | 9/1982 | White et al. | 102/378 |

*Primary Examiner*—Deborah L. Kyle
*Assistant Examiner*—Ted L. Parr
*Attorney, Agent, or Firm*—R. F. Beers; C. D. B. Curry; W. C. Daubenspeck

[57] ABSTRACT

Explosive separation apparatus in which a LSC is supported by a plurality of narrow preform supports which provide intermittent support at predetermined positions to maintain the LSC at the required standoff and perpendicularity to the target. The orientation of the supports themselves is maintained flat against the missile skin by a properly sized tunnel in the backup ring. The supports have a channel which maintains the LSC in the required orientation and standoff. A slot in each support below the liner walls of the LSC eliminates any obstruction from the support between the LSC and the target. The supports are maintained at the required spacing by a wire lanyard system which also allows the support system including the LSC to be installed in or removed fron a backup ring without applying any longitudinal forces to the LSC itself. A Venturi Plate provides a dual target to prevent delamination or splintering when cutting a target of composite material.

11 Claims, 12 Drawing Figures

APPARATUS FOR AEROSPACE VEHICLE SEPARATION EVENTS USING A LINEAR SHAPED CHARGE

BACKGROUND OF THE INVENTION

This invention relates generally to explosive separation apparatus and, more particularly, to a support system for maintaining a linear shaped charge (LSC) at any designated standoff and orientation to the target surface to be cut. This invention particularly relates to explosive separation apparatus which is especially suitable for separating aluminum or composite laminate shells employed in aerospace vehicles, or commercial pressure vessels which may require immediate pressure relief along an entire periphery.

Aerospace vehicle skins or shells are generally made of aluminum and stage separation and/or payload release is achieved by functioning a Mild Detonating Fuse (MDF)—a circular linear explosive (e.g. Primacord) composed of an explosive core (RDX, HMX, HNAB, etc.) confined by an aluminum or lead sheath. Cutting the aerospace vehicle skin is effected by the combined detonation shock wave and high gas pressure generated by the explosion.

With the advent of high strength to weight composite materials, e.g. graphite-epoxy laminates, the aluminum skin for the various missile sections is being replaced by this light weight material to gain range. However, MDF is not suitable for properly cutting composite missile skins. The only acceptable technique for cutting a composite missile skin found to date is use of an explosive in the form of a LSC. Cutting the missile skin is effected by directing the output jet—a stream of hot, high velocity metallic particles from the lined cavity walls of the chevron configured linear explosive charge—perpendicular to the target, i.e., missile skin. The converging energetic particles from both liner walls of the chevron cavity require a certain distance to reach a maximum velocity, i.e., cutting efficiency, therefore, LSC's require a certain "standoff" range above the target for successful cutting. The standoff is best determined by actual system tests.

Linear shaped charges used for aerospace vehicle separations are usually supported by plastic (Nylon) or rubber (Silicone) extruded preforms which provide the required standoff and perpendicularlity. These preform extrusions are continuous and have fairly high densities, e.g., Nylon—71 lbs/ft$^3$; Silicone rubber—125 lbs/ft$^3$. These flexible preforms with the LSC inserted in place are mounted on a missile skin and then a backup structure is secured to the missile shell to keep the preform/LSC in its proper location and also to capture all metal shrapnel or "flak" from the exploding LSC. It is necessary to confine all high density particles or fragments to prevent damage to surrounding electronics or other sensitive components.

The LSC detonation shock wave is transmitted through the continuous preform to the backup structure since they are in physical contact. This requires the backup ring to be substantial and therefore heavy piece of missile skin addendum. The back structure should have a minimum weight design in order to have the least effect on missile range.

An attempt has been made to lower the detonation shock wave pressure transfer at the preform/backup interface—thereby minimizing the need for a heavy backup structure by reducing the density of the plastic or rubber preform support. A polyurethane foam support has been developed which is kept in the 10–15 lbs/ft$^3$ density range to balance two needs: (1) adequate support for the LSC; and (2) a minimum weight backup ring. The backup material may be a composite or aluminum.

The foam support system has disadvantages related to the long-term degradation with age of the foam itself or the bond between the foam and the LSC. The LSC may become unbonded due to twisting stresses set up during manufacturing or due to vibrations or other stresses present in the installed environment. The foam may become degraded and no longer properly support the LSC. Since polyurethane foam absorbs fluids and softens and may swell, the effectiveness of the LSC may be significantly reduced if water or other fluids get into the separation joint. Upon functioning of the LSC, excessive loads may be put on the backup ring by hydraulic shock due to the presence of the fluid. If water bridges the continuous slot in the foam support, it will significantly reduce the LSC cutting. Some aerospace vehicle applications use a hermetically sealed system to preclude entry of water, dust and other foreign objects.

Additionally, bonding the LSC to a foam support would result in the application of undesirable axial loads on the LSC itself during installation or removal.

SUMMARY OF THE INVENTION

It is therefore an object of the present invention to provide explosive separation apparatus for separating aluminum or composite shells exployed in aerospace vehicles.

Another object is to provide an explosive separation system that can provide intermittent cutting or multiple cutting with a single initiation event.

Another object is to provide an all-metal, flexible, and intermittent support system for maintaining a LSC at any designated standoff and perpendicularity to the target surface to be cut.

Another object is to provide an intermittent support system for a LSC in which the LSC apparatus may be installed or removed from the tunnel formed by the backup structure without applying any longitudinal forces on the explosive device itself.

A further object is to provide an intermittent support system providing long-term reliability in various environments.

Another object is to provide a support system which reduces detonation shock on the backup structure and thus reduces the weight of the required backup structure.

These objects and others are provided by an explosive separation apparatus in which a LSC is supported by a plurality of narrow preform supports which provide intermittent support at predetermined positions to maintain the LSC at the required standoff and perpendicularity to the target. The orientation of the supports themselves is maintained flat against the missile skin by a properly sized tunnel in the backup ring. The supports have a channel which maintains the LSC in the required orientation and standoff. A slot in each support below the liner walls of the LSC eliminates any obstruction from the support between the LSC and the target. The supports are maintained at the required spacing by a wire lanyard system which also allows the support system including the LSC to be installed in or removed from a backup ring without appyling any longitudinal forces to the LS itself. A Venturi Plate provides a dual target to prevent delamination or splintering when cutting a target of composite material.

Other advantages and features of the invention will become apparent from the following description of the preferred embodiment when considered in conjunction with the accompanying drawings wherein:

DESCRIPTION OF THE PREFERRED EMBODIMENT

Figure 1:
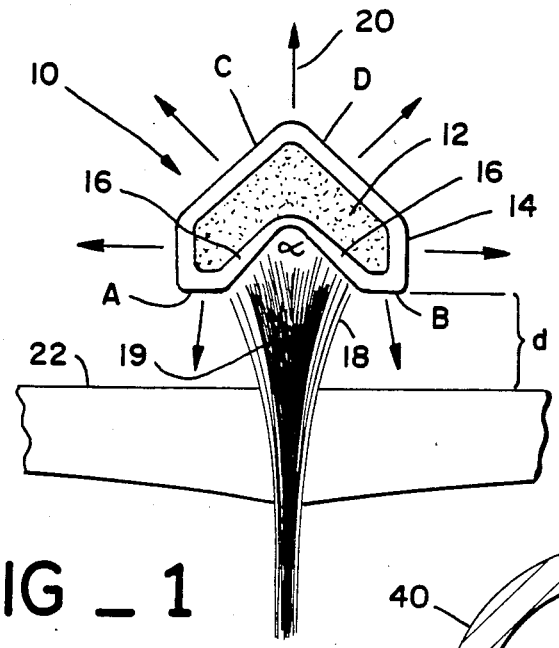
FIG. 1 is a cross-sectional flow illustrating a typical linear shaped charge and the jet produced of a functioning LSC.

Referring now to the drawings and, in particular to FIG. 1, a typical linear shaped charge (LSC) 10 has an explosive core 12 confined by a metal sheath 14. The LSC 10 has a chevron-shaped cross-section having a chevron angle between the liner walls 16. Detonation of the LSC 10 results in a directed jet 18 (having a core 19) of hot, high velocity metallic particles from the liner walls 16. The detonation also produces a coaxial shock wave and flak directed as indicated by arrows 20. For maximum cutting efficiency, the LSC is disposed at a standoff distance d from the target 22 and oriented so that the bisector of the chevron angle is perpendicular to the surface 22 to be cut.

Figure 3B:
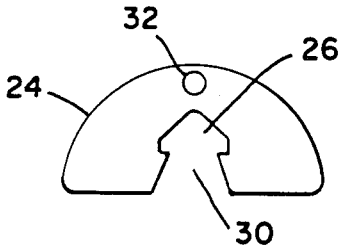
FIG. 3*b* is an end view of a support without the LSC installed and the lanyard.
Figure 3A:
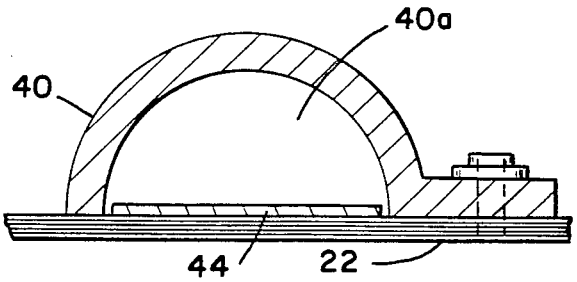
FIG. 3*a* is a cross-sectional view of a typical separation and backup structure prior to installation of the LSC apparatus.
Figure 3C:
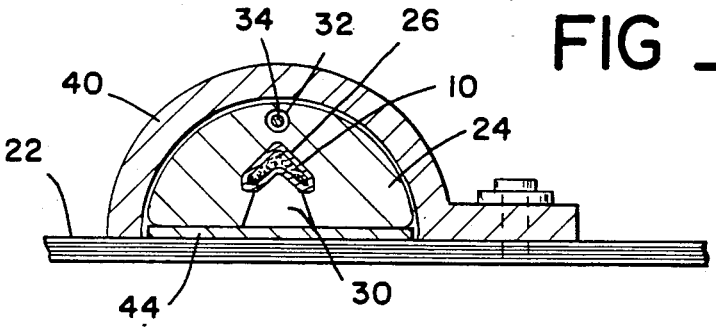
FIG. 3*c* is a cross-sectional view of an installed LSC apparatus taken along line 3—3 in FIG. 2.
Figure 2:
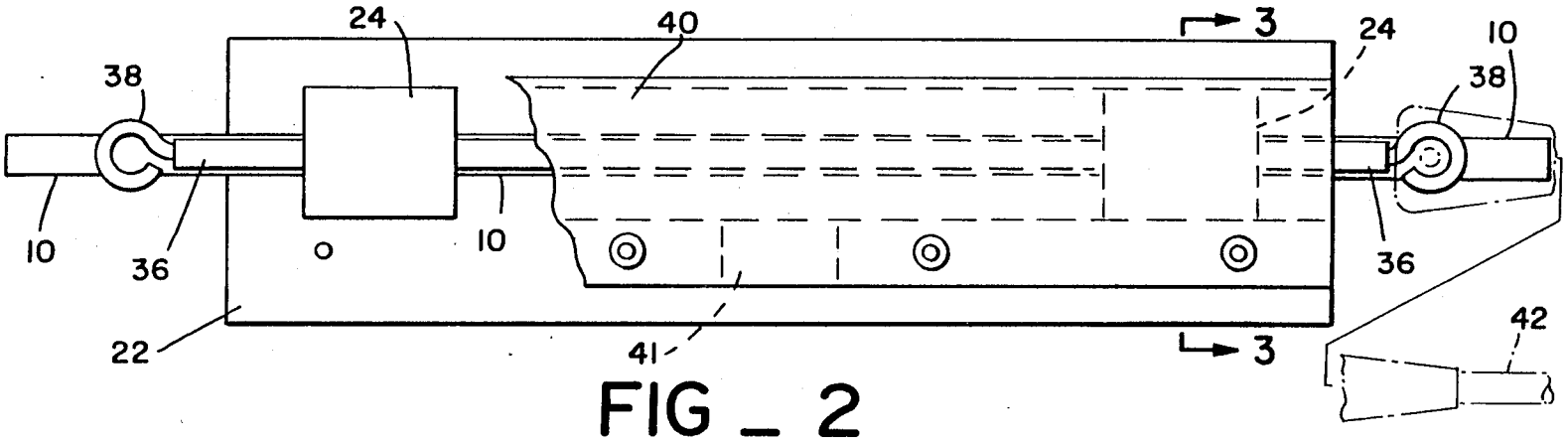
FIG. 2 is a plan view a preferred embodiment of explosive separation apparatus and backup structure according to the present invention.
Figure 4:
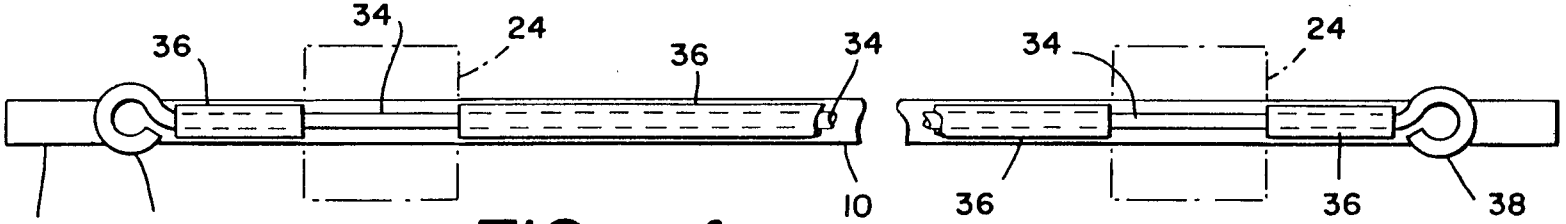
FIG. 4 illustrates one technique for maintaining spacing of the supports.

FIGS. 2–4 illustrate a preferred embodiment of the support system of the present invention which is especially suitable for use in cutting a missile skin of structural composites or of aluminum with a LSC. The support system includes a plurality of aluminum preform extrusion support 24 which provide intermittent support at predetermined positions to maintain the LSC at a fixed standoff from the target surface 22 and maintain the required perpendicularity to the target surface. The supports 24, A, B, C are restrained flat against the missile skin 22 (actually against the banded Venturi Plate 44) by a properly sized tunnel cavity 40*a* in the backup ring. (See FIG. 3*a*). All edges of each support 24 A, B, C are chamfered and rounded to prevent any gauging hangups during installation/removal from tunnel 40*a*. All contact surfaces of supports 24 A, B, C can be coated to prevent galvanic action corrosion. The supports 24 have a channel 26 configured to restrain the LSC 10 at surface areas A, B, C and D (See FIG. 1) to support the LSC in the required orientation and standoff from the target surface 22. The LSC 10/channel 26 interface is a slip fit permitting the LSC to move longitudinally in the channel 26 to allow the LSC to be inserted through the channel 26 during manufacturing assembly without applying excessive longitudinal forces which could deform the LSC to the point of altering its cutting efficiency. Each support 24 has a slot 30 below the liner walls 16 to eliminate interference between the directed jet 18, and especially the core jet 19, and the target surface 22. As long as channel 26 in support 24 provides the required restraint at the four surfaces A, B, C and D of LSC 10 and support 24 design allows no interference between the jet 18 and the target 22, the design of the support can vary.

The frequency of the supports, that is, how far apart the supports can be spaced to maintain the required standoff during missile flight, depends on the stiffness of the LSC and the missile vibration levels. Once the spacing has been experimentally determined, there must be assurance that the supports will remain at their predetermined positions over an extended period of time under various vibration environments. For example, submarine launched missiles must withstand submarine vibrations. For this purpose, each support 24 has a longitudinal hole 32 above the channel 26 for receiving a wire lanyard 34 which extends through each support 24 for the entire length of tunnel 40*a*. The supports 24 are maintained at the required spacing by metal spacer tubes 36 which are slipped over the wire lanyard 34 as it is passed through the supports during manufacturing assembly. The ends of the thin walled metal spacer tubes 36 are flared to a larger diameter than that of the holes 32 in the supports 24 to lock the supports at the proper separation. After the lanyard 34 has been inserted through the supports 24 and the spacer tubes 36, hooks 38 are attached to the ends of the wire (or the ends of the wire are bent to form hooks) to provide a means for installing or removing the LSC 10 without applying any axial loads to the LSC itself. This factory assembled LSC apparatus is then transferred to a shipping/storage container tunnel configured and sized identically to the backup ring tunnel 40*a*. This shipping/storage container is necessary to prevent kinking, excessive twisting, and other damage to the LSC 10 which could affect its highly reliable performance.

The factory assembled apparatus (LSC 19, supports 24, wire lanyard 34 and spacer tubes 36) is now ready to be installed in the tunnel 40*a* formed by the backup structure (ring) 40 which maintains the support system in position. A steel cable or graphite rod 42 (having a length 2'–3' in excess of tunnel 40*a* length) is first inserted into tunnel 40*a* and the aft end of cable 42 is secured to one of the hooks 38 after the shipping/storage container has been properly positioned and stabilized at the separation joint LSC 10 installation point. The LSC 10 apparatus is then transferred directly from the shipping/storage container into tunnel 40*a* by pulling cable 42. Since the installation/removal tensile loads are applied only to the support structure, the LSC 10 is not subjected to any axial loading. Both hooks 38 of the wire lanyard 34 are pulled towards each other and the hooks 38 lockwired together. The two initiation ends of LSC 10 are then secured properly in an initiation block. The intermittent positioning of the supports 24, which typically only need be three-eights to three-quarters of an inch long, provides a minimum detonation shock transmitting path to the backup ring 40. Short one-quarter inch long supports can be positioned between main supports to maintain the proper standoff for sharp curvatures as in the case of small diameter missiles.

Drain slots 41 are provided in the aft side of backup ring 40 to prevent liquid from being trapped within the support structure and deleteriously affecting operation of the LSC 10.

A composite aerospace vehicle skin can be cut with a Mild Detonating Fuze; however, the result will be a shattered target. A relatively clean cut is desired and use of a LSC can usually accomplish this. However, due to variability in manufacture of a composite shell such as a missile skin, even a LSC can produce unsatisfactory results such as delamination and/or spalling in the cut area. To prevent this delamination and/or spalling, a thin metallic sheet 44, referred to herein as a Venturi Plate, is bonded to the missile skin 22 centered at the location of the LSC jet 18.

This Venturi Plate 44 prevents delamination or fracturing of the composite skin through a series of nearly concurrent factors. The Venturi Plate 44 is preferably of the same material as the metal sheath 14 of the LSC 10. The sheath 14 is typically aluminum by may be copper, lead or various other metals. When the sheath 14 and the Venturi Plate 44 are of the same metal, a damping effect or impedance match is provided for the detonation shock wave striking the target. The Venturi Plate 44 also acts as a decelerator barrier for peripheral jet stream fragments of aluminum from the liner walls 16, thus reducing the impulse loading on the composite missile skin on each side of the jet cut.

The jet of hot, high velocity aluminum particles and gases from the liner walls 16 penetrating the aluminum Venturi Plate 44 results in a target explosion phenomenon which coats the two inside surfaces of the cut with molten or fused aluminum producing a venturi-shaped cavity. The high pressure gases produced by the explosion in the backup ring 40 vent out through the metal-lined cut thus minimizing delamination by preventing the gases from forcing entry between the layers of composite missile skin.

The aluminum Venturi Plate 44 bonded to the composite missile skin sets up a situation where the jet 18 has to penetrate different target materials. Such a dual penetration target operates according to a hole-expansion theory. The target Venturi Plate 44 should have about the same mass as the liner walls 16 to absorb the total kinetic energy of the high velocity fragments. Thus the aluminum plate 44 should be slightly thicker than the aluminum liner wall 16.

Figure 5:
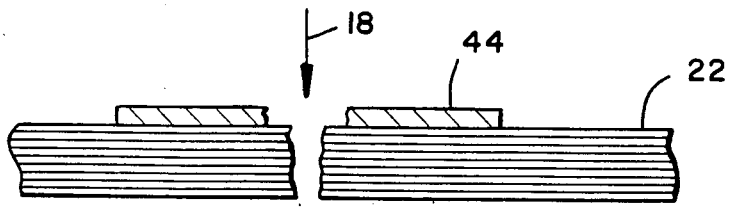
FIG. 5 illustrates the cut produced in a composite material when a Venturi Plate is employed as a first target.

Upon impacting the target 22, the energy in the forward portion or edge of the jet stream melts the first target material, the aluminum plate 44. The continuing advance of the jet stream particles causes lateral flow melting or expansion in the aluminum plate 44. The core 19 of the jet 18 continues on to penetrate the second target, i.e., the composite shell in this application. The core of the jet is much narrower than the impacting jet. As illustrated in FIG. 5 the final cut in the aluminum plate 44 is much wider than the width of the jet core penetrating the composite missile shell.

The knife-like high velocity jet core produces a clean cut in the second target without delamination or shattering of the composite material. Without the sacrificial aluminum plate 44 creating a different material target, the hole expansion created by the lateral flow or expansion would take place in the initial target material 22, resulting in delamination of the composite missile skin. This suggest that a sheet of dissimilar material should be used as a first target whenever a smooth, narrow cut is required when cutting with a LSC.

Figure 6B:
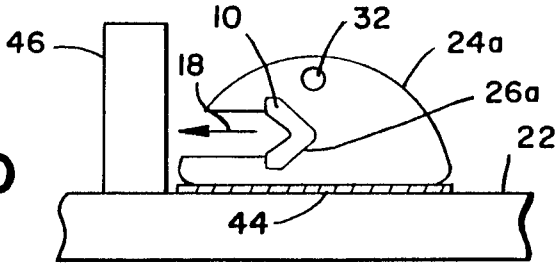
FIGS. 6*a* and 6*b* illustrate first type and second type supports for providing intermittent cutting with a single initiation.
Figure 6A:
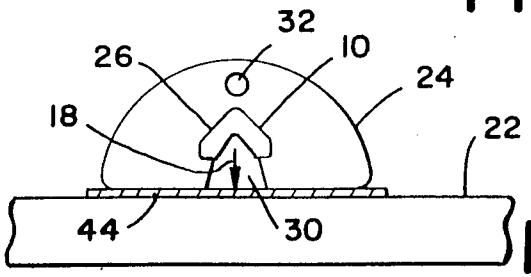
Figure 7:
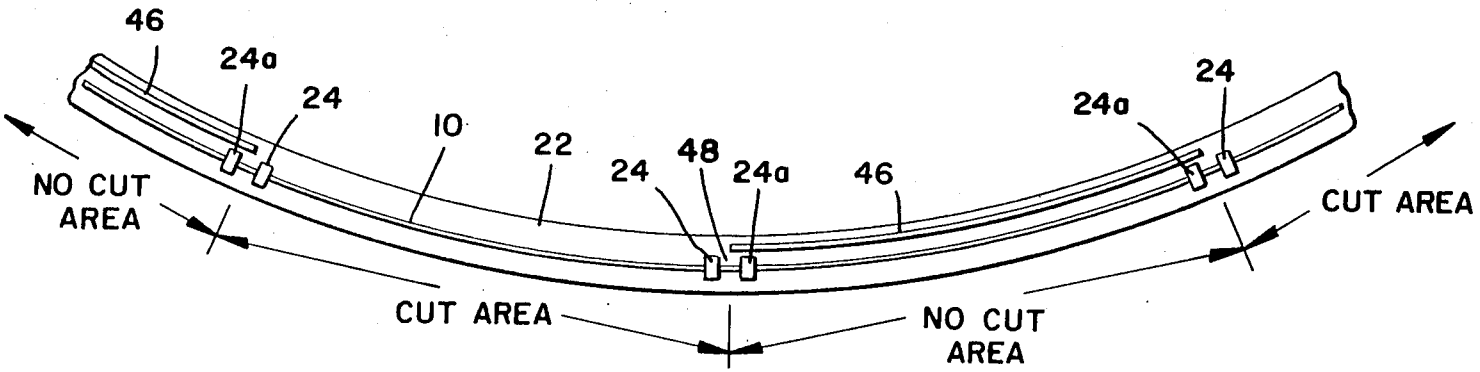
FIG. 7 illustrates a support system for intermittent cutting.

The support system of the present invention can provide intermittent cutting or multiple cutting with a single initiation event as illustrated in FIGS. 6 and 7. FIGS. 6*a* and 6*b* show support 24 where the LSC channel 26 is oriented to direct the jet 18 to the missile skin 22 and support 24*a* where the LSC channel 26*a* is rotated ninety degrees to direct the jet 18 toward a sacrificial member 46. Support types 24 and 24*a* are slipped on to the LSC 10 and properly spaced to provide cutting action only where required as shown in FIG. 7. Once the supports 24*a* are positioned and the wire lanyard 34 and metal spacer tubes 36 are inserted, the LSC 10 is carefully turned (twisted) within the LSC turn zone 48 until the base of support 24*a* is parallel to the target or missile skin 22. The entire assembly is then installed in the backup ring tunnel as described earlier. The sacrificial member 46 or a reinforced backup ring is needed to absorb the jet impulse and energy in the no-cut areas.

Figure 8:
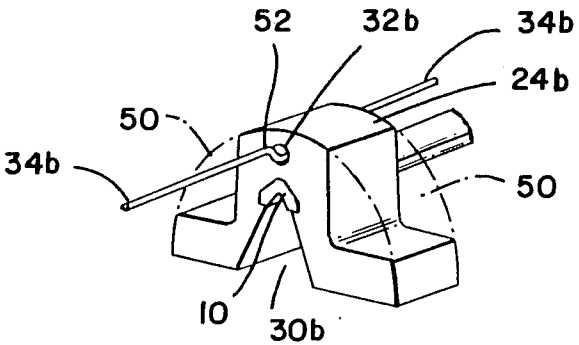

As noted hereinbefore, the design of supports 24 can vary as long as the proper support is provided at surface areas A, B, C, and D and a slot 30 eliminates interference with the directed jet 18. FIG. 8 shows an alternative support structure 24*b* which is similar to support 24 but in which areas 50 within dashed lines have been removed to reduce weight and/or reduce the material available for producing shrapnel upon explosion of the LSC. FIG. 8 also illustrates an alternative means of securing the support 24*b* in position. In this case, the lanyard wire 34*b* is offset as shown at 52, before and after passing through the longitudinal hole 32*b* to fix the support in position.

Figure 9:
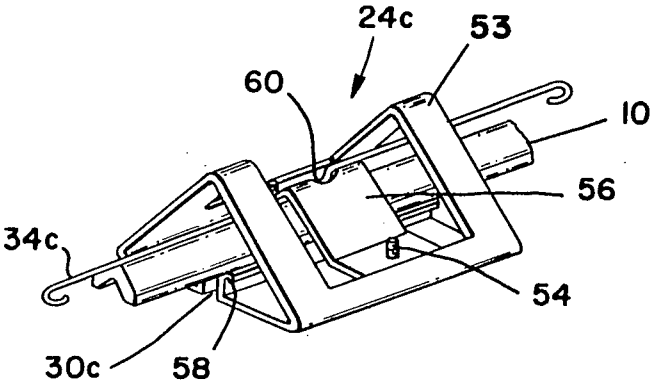
FIGS. 8 and 9 illustrate alternate designs for supports within the teachings of the present invention.

FIG. 9 shows a support 24*c* made from sheet metal frame 53 for a triangular backup ring. It is noted that support 24*c* could have other shapes to conform to the shape of the backup ring tunnel. The LSC 10 is secured by means of a screw 54 which pulls a restrainer 56 down to secure the LSC against two rising tabs 58 which support the LSC and form the sides of the slot 30*c*. FIG. 8 also illustrates a wire lanyard 34*c* which extends between each sheet metal support and is secured to the supports by an offset in the wire before and after it passes through an eyelet 60 at the top of the restrainer 56.

Obviously many modifications and variations of the present invention are possible in the light of the above teachings. It is therefore to be understood that with the scope of the appended claims the invention may be practiced otherwise than as specifically described.

What is claimed is:

1. Apparatus for explosive separation of a target using a linear shaped charge, which comprises:

(a) a linear shaped charge, said linear shaped charge having an explosive core confined by a metal sheath, said linear shaped charge having a chevron shaped cross-section and having a chevron angle between liner walls of the sheath, detonation of said linear shaped charge resulting in a directed jet of particles from the liner walls;

(b) a plurality of intermittently spaced supports for maintaining said linear shaped charge at the desired standoff and orientation;

(c) said supports having a longitudinal channel oriented to maintain the linear shaped charge at a fixed standoff and at the required perpendicularity to the target, to facilitate production assembly of the linear shaped charge/supports;

(d) said supports having a longitudinal slot between said channel and the target to eliminte all interference between the jet of the linear shaped charge and the target;

(e) means for maintaining the spacing of said plurality of supports;

(f) a backup structure to maintain the supports in the proper location relative to the target to be separated and confine shrapnel from the exploding linear shaped charge to prevent damage to nearby apparatus; and (g) a thin metallic sheet disposed on the target below the apex of the linear shaped charge, said metallic sheet acting as a Venturi Plate to produce a clean cut in the target material.

2. Apparatus as recited in claim 1 wherein said thin metallic sheet has about the same mass as the liner walls of the linear shaped charge to absorb the total kinetic energy of the high velocity fragments.

3. Apparatus as recited in claim 1 wherein said thin metallic sheet is of the same metal as the sheath of the liner shaped charge.

4. Apparatus as recited in claim 1 wherein said thin metallic sheet is of a different material than the target surface.

5. Apparatus as recited in claim 4 wherein said thin metallic sheet is of the same metal as the sheath of the linear shaped charge.

6. Apparatus as recited in claim 1 wherein said supports are preformed metallic supports.

7. Apparatus for explosive separation of a target using a linear shaped charge, which comprises:

(a) a linear shaped charge, said linear shaped charge having an explosive core confined by a metal sheath, said linear shaped charge having a chevron shaped cross-section and having a chevron angle between liner walls of the sheath, detonation of said linear shaped charge resulting in a directed jet of particles from the liner walls;

(b) a plurality of intermittently spaced supports for maintaining said linear shaped charge at the desired standoff and orientation;

(c) said supports having a longitudinal channel oriented to maintain the linear shaped charge at a fixed standoff and at the required perpendicularity to the target, to facilitate production assembly of the linear shaped charge/supports;

(d) said supports having a longitudinal slot between said channel and the target to eliminate all interference between the jet of the linear shaped charge and the target;

(e) said supports further having a longitudinal hole disposed above said longitudinal channel;

(f) means for maintaining the spacing of said plurality of supports including a wire lanyard extending through said holes in said supports for the entire length of said apparatus and a plurality of spacer tubes through which said wire is passed through between said supports, said spacer tubes having an end diameter larger than said holes in said supports to lock the supports at the proper separation; and (g) a backup structure to maintain the supports in the proper location relative to the target to be separated and confine shrapnel from the exploding linear shaped charge to prevent damage to nearby apparatus.

8. Apparatus as recited in claim 7 further comprising a thin metallic sheet disposed on the target below the apex of the LSC, said metallic sheet acting as a Venturi Plate to produce a clean cut in the target material.

9. Apparatus for explosive separation of a target using a linear shaped charge, which comprises:

(a) a linear shaped charge, said linear shaped charge having an explosive core confined by a metal sheath, said linear shaped charge having a chevron shaped cross-section and having a chevron angle between liner walls of the sheath, detonation of said linear shaped charge resulting in a directed jet of particles from the liner walls;

(b) a plurality of intermittently spaced supports for maintaining said linear shaped charge at the desired standoff and orientation;

(c) said supports having a longitudinal channel oriented to maintain the linear shaped charge at a fixed standoff and at the required perpendicularity to the target, to facilitate production assembly of the linear shaped charge/supports;

(d) said supports having a longitudinal slot between said channel and the target to eliminate all interference between the jet of the linear shaped charge and the target;

(e) said supports further having a longitudinal hole disposed above said longitudinal channel;

(f) means for maintaining the spacing of said plurality of supports including a wire lanyard extending through said holes in said supports for the entire length of said apparatus, said wire lanyard being offset on each side of each said support to lock the supports at the proper separation; and (g) a backup structure to maintain the supports in the proper location relative to the target to be separated and confine shrapnel from the exploding linear shaped charge to prevent damage to nearby apparatus.

10. Apparatus as recited in claim 9 further comprising a thin metallic sheet disposed on the target below the apex of the LSC, said metallic sheet acting as a Venturi Plate to produce a clean cut in the target material.

11. Apparatus for explosive separation of a target using a linear shaped charge, which comprises:

(a) a linear shaped charge, said linear shaped charge having an explosive core confined by a metal sheath, said linear shaped charge having a chevron shaped cross-section and having a chevron angle between liner walls of the sheath, detonation of said linear shaped charge resulting in a directed jet of particles from the liner walls;

(b) a plurality of intermittently spaced supports for maintaining said linear shaped charge at the desired standoff and orientation;

(c) said supports having a longitudinal channel oriented to maintain the linear shaped charge at a fixed standoff and at the required perpendicularity to the target, to facilitate production assembly of the linear shaped charge/supports;

(d) said supports having a longitudinal slot between said channel and the target to eliminate all interference between the jet of the linear shaped charge and the target;

(e) said supports further having a longitudinal hole disposed above said longitudinal channel;

(f) each of said supports including a sheet metal frame having two rising tabs which support the linear shaped charge and form the sides of said longitudinal slot and a sheet metal restrainer adapted to secure the linear shaped charge against the two rising tabs, said restrainer being secured to said frame and having an eyelet disposed above said linear shaped charge;

(g) means for maintaining the spacing of said plurality of supports including a wire lanyard extending through said eyelet in said restrainer in said support for the entire length of said apparatus, said wire being offset as it passes through the eyelet to lock said supports at the proper separation; and (h) a backup structure to maintain the supports in the proper location relative to the target to be separated and confine shrapnel from the exploding linear shaped charge to prevent damage to nearby apparatus.

* * * * *